US011545780B1

(12) United States Patent
Roberts

(10) Patent No.: US 11,545,780 B1
(45) Date of Patent: Jan. 3, 2023

(54) PURPOSE BUILT CABLE CONNECTOR

(71) Applicant: Raytheon Company, Waltham, MA (US)

(72) Inventor: Harrison Roberts, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 17/465,048

(22) Filed: Sep. 2, 2021

(51) Int. Cl.

| | |
|---|---|
| ***H01R 13/625*** | (2006.01) |
| ***H01R 13/514*** | (2006.01) |
| ***H01R 13/05*** | (2006.01) |
| ***H01R 13/58*** | (2006.01) |
| ***H01R 13/627*** | (2006.01) |

(52) U.S. Cl.
CPC ..... *H01R 13/514* (2013.01); *H01R 13/052* (2013.01); *H01R 13/5812* (2013.01); *H01R 13/5837* (2013.01); *H01R 13/6271* (2013.01)

(58) Field of Classification Search
CPC .. H01R 13/193; H01R 13/639; H01R 9/0757; H01R 43/16
See application file for complete search history.

(56) References Cited

U.S. PATENT DOCUMENTS

| | | | | |
|---|---|---|---|---|
| 4,988,305 | A * | 1/1991 | Svenkeson | H01R 12/82 439/708 |
| 4,997,390 | A * | 3/1991 | Scholz | H01R 12/737 439/511 |
| 5,597,318 | A * | 1/1997 | Townsend | H05K 7/1007 439/259 |
| 5,661,244 | A * | 8/1997 | Nishimura | G01L 19/0038 73/706 |
| 6,375,473 | B1 * | 4/2002 | Schliebe | H01R 12/57 439/930 |
| 7,275,936 | B1 * | 10/2007 | Ju | H01R 13/2435 439/591 |
| 7,791,443 | B1 * | 9/2010 | Ju | H01R 12/52 336/107 |

* cited by examiner

*Primary Examiner* — Phuong Chi Thi Nguyen
(74) *Attorney, Agent, or Firm* — Bachman & LaPointe, P.C.

(57) ABSTRACT

A cable connector including a housing with a main body having a front face opposite a rear face and pin holes formed through the main body extending between the front face and the rear face, a first arm and second arm extending from the main body distal from the rear face; a cover removably coupled to the front face, the cover including receivers configured to align with the pin holes to receive either a pin or a socket connected at a terminal end of a wire; fasteners removably coupled to the cover and the housing; at least one guide post extending from an outer surface of the cover; a collar supported between the first arm and the second arm; and a predetermined pattern of the wire coupled to at least one of the pin and the socket, wherein either the pin or the socket are insertable in the pin hole.

20 Claims, 9 Drawing Sheets

PURPOSE BUILT CABLE CONNECTOR

This invention was made with U. S. Government support under contract number FA8675-16-C-0044, sponsored by the Department of Defense. The U. S. Government has certain rights in this invention.

BACKGROUND

The present disclosure is directed to cable connectors, and more particularly a cable connector with adjustable pin and socket contacts secured in an assembly.

Remote monitoring and testing equipment requires the use of cable to transmit sensor signals from the sensor to the testing equipment processors. In most testing systems, multiple cables are needed to properly transmit the signals to the testing equipment processors from the sensors. The remote monitoring devices are custom built and include non-standard cable or cable end connectors that do not accept standard round stranded wire cable connectors and have no existing mating cable. Custom mating cable connectors must be fabricated. Prior attempts to affix stacking connectors onto the end of a cable involved various glues, epoxies, and/or solder to permanently affix wires to the contacts of the stacking connector. Additional solutions required a custom fixed configuration printed wiring board which allows the stacking connector contacts to be routed to an additional connector which has commercially available mating cables/cable-end connectors.

The use of custom fixed configuration connectors requires long lead times and only functions with the one remote monitoring device. Additionally, these prior solutions require additional design and hardware, lack robust configurations and cannot be reconfigured.

What is needed is a purpose-built housing that can be configured with a predetermined array of contacts that mate with an assembly of cable wires to couple to a desired stacking connector.

SUMMARY

In accordance with the present disclosure, there is provided a cable connector comprising a housing including a main body having a front face opposite a rear face and pin holes formed through the main body extending between the front face and the rear face, a first arm and second arm extending from the main body distal from the rear face; a cover removably coupled to the front face, the cover including receivers configured to align with the pin holes to receive at least one of a pin and a socket at a terminal end of at least one wire insertable through the pin holes; fasteners removably coupled to the cover and the housing; at least one guide post extending from an outer surface of the cover; a collar supported between the first arm and the second arm; and a predetermined pattern of the wires coupled to at least one of the pin and the socket, wherein either the pin or the socket are insertable in the pin hole.

A further embodiment of any of the foregoing embodiments may additionally and/or alternatively include the housing, the cover, the at least one wire, the pin and the socket are configured to be at least one of rearranged, repaired and reworkable.

A further embodiment of any of the foregoing embodiments may additionally and/or alternatively include the predetermined pattern can be adjusted.

A further embodiment of any of the foregoing embodiments may additionally and/or alternatively include the housing can contain multiple predetermined patterns.

A further embodiment of any of the foregoing embodiments may additionally and/or alternatively include the cable connector further comprising an additional arm coupled to the first arm and the second arm.

A further embodiment of any of the foregoing embodiments may additionally and/or alternatively include the additional arm is coupled to an additional collar and configured with a 90 degree bend relative to the pin holes.

A further embodiment of any of the foregoing embodiments may additionally and/or alternatively include the collar comprises a fixed portion and a locking portion removably coupled to the fixed portion, the collar configured to provide strain relief to a bundle of the wire.

In accordance with the present disclosure, there is provided a cable connector comprising a housing including a main body having a front face opposite a rear face and pin holes formed through the main body extending between the front face and the rear face, a first arm and second arm opposite the first arm extending from the main body distal from the rear face; a cover removably coupled to the front face, the cover including receivers configured to align with the pin holes to receive at least one of a pin and a socket at a terminal end of at least one wire; fasteners removably coupled to the cover and the housing; at least one guide post extending from an outer surface of the cover; a collar supported between the first arm and the second arm; and a predetermined pattern of the wire inserted into the pin holes and coupled to at least one of the pin and the socket at a terminal end of the wire, wherein either of the pin and the socket are insertable in the pin hole.

A further embodiment of any of the foregoing embodiments may additionally and/or alternatively include the housing, the cover, the at least one wire, the pin and the socket are configured to be at least one of rearranged, repaired and reworkable.

A further embodiment of any of the foregoing embodiments may additionally and/or alternatively include the housing can contain multiple predetermined patterns.

A further embodiment of any of the foregoing embodiments may additionally and/or alternatively include the first arm and the second arm are spaced apart to provide access to insert the at least one wire into a pin hole.

A further embodiment of any of the foregoing embodiments may additionally and/or alternatively include the cable connector further comprising an additional arm coupled to the first arm and the second arm, wherein the additional arm is coupled to an additional collar and configured with a 90 degree bend relative to the pin holes.

A further embodiment of any of the foregoing embodiments may additionally and/or alternatively include the predetermined pattern can be adjusted.

In accordance with the present disclosure, there is provided a process for configuring an adaptable cable connector comprising providing a housing including a main body having a front face opposite a rear face and pin holes formed through the main body extending between the front face and the rear face, a first arm and second arm extending from the main body distal from the rear face and a collar supported between the first arm and the second arm; providing a detachable cover including receivers configured to align with the pin holes; attaching the cover to the front face such that the receivers of the cover align with the pin holes of the main body; inserting at least one wire through the pin holes; and forming a predetermined pattern of the wires inserted into the pin holes and coupled to at least one of a pin and a socket at a terminal end of the wires, wherein either of the pin and the socket are insertable in the pin hole.

A further embodiment of any of the foregoing embodiments may additionally and/or alternatively include the process further comprising rearranging at least one of the housing, the cover, the at least one wire, the pin and the socket.

A further embodiment of any of the foregoing embodiments may additionally and/or alternatively include the process further comprising adjusting the predetermined pattern.

A further embodiment of any of the foregoing embodiments may additionally and/or alternatively include the process further comprising creating multi-connector assemblies on the housing.

A further embodiment of any of the foregoing embodiments may additionally and/or alternatively include the process further comprising providing additional arms coupled to each of the first arm and the second arm, wherein the additional arms are coupled to an additional collar and the additional arms are configured with a 90 degree bend relative to the pin holes.

A further embodiment of any of the foregoing embodiments may additionally and/or alternatively include the collar comprises a fixed portion and a locking portion removably coupled to the fixed portion, the collar configured to provide strain relief to a bundle of the wire.

A further embodiment of any of the foregoing embodiments may additionally and/or alternatively include the process further comprising providing additional arms on the housing and coupling additional collars to the additional arms configured to change a cable direction relative to the alignment of the pin holes.

Other details of the cable connector are set forth in the following detailed description and the accompanying drawings wherein like reference numerals depict like elements.

DETAILED DESCRIPTION

Figure 1:
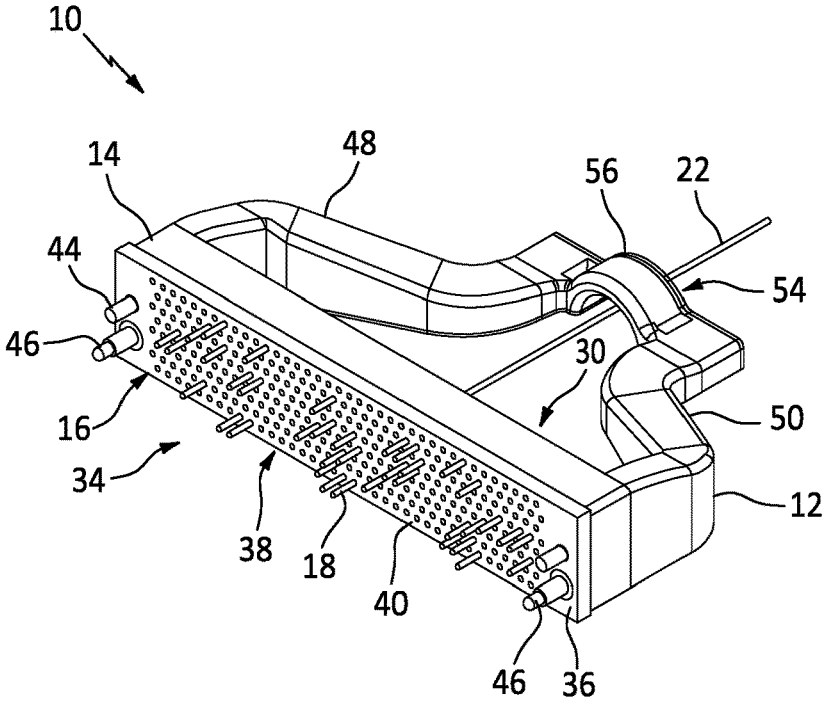
FIG. 1 is an isometric view of an exemplary cable connector.
Figure 2:
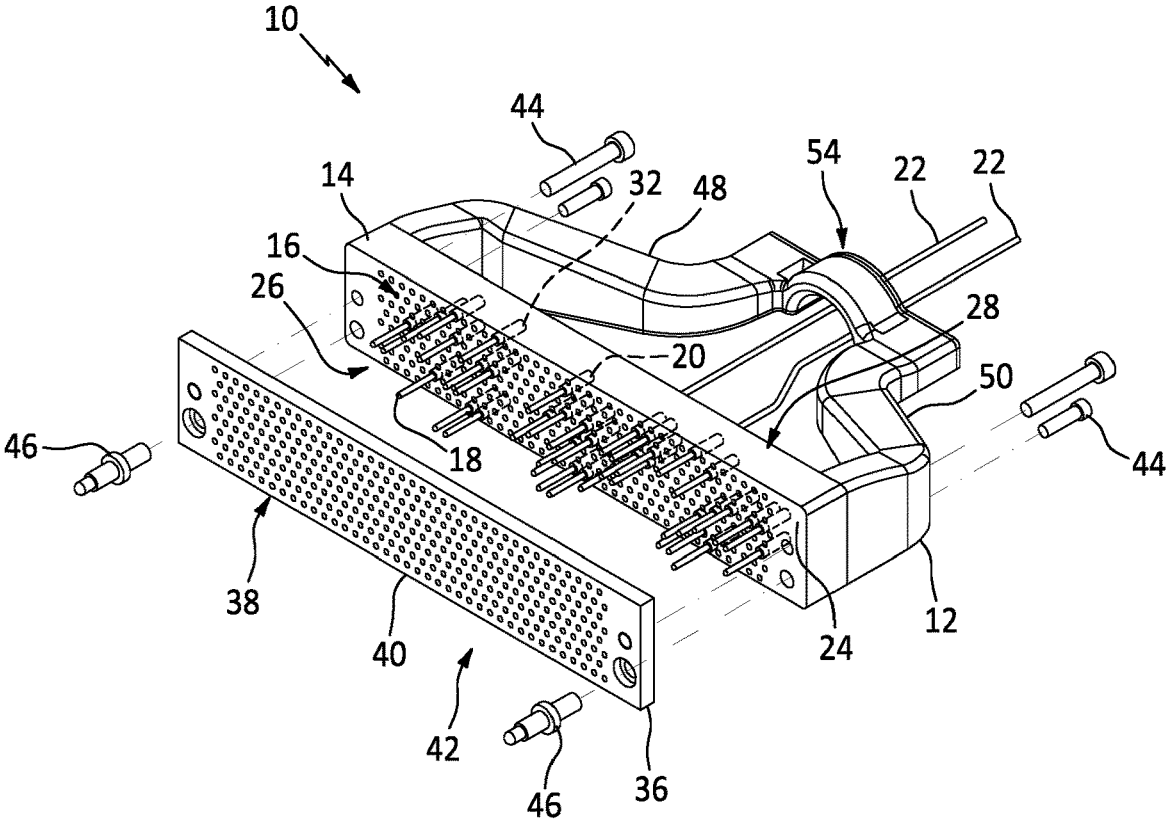
FIG. 2 is an exploded view of the exemplary cable connector.

Referring now to FIGS. 1 and 2, an exemplary cable connector 10 is shown. The cable connector 10 includes a housing 12. The housing 12 includes a main body 14 with an array of receivers/pin holes 16 configured to receive at least one of a crimp pin 18 and/or a crimp socket 20 and/or a wire 22.

The pin hole 16 can be shaped as a right circular cylinder with two diameters that include a first diameter 24 proximate a front face 26 of the main body 14. The pin hole 16 can include a second diameter 28 proximate a rear face 30 of the main body 14. At the intersection between the first diameter 24 and the second diameter 28 a ledge 32 is formed in the pin hole 16. The first diameter 24 is larger than the second diameter 28.

The second diameter 28 can be configured to receive the wire 22 proximate the rear face 30. The first diameter 24 can be configured to receive the pin 18 or socket 20 proximate the front face 26. The ledge 32 can be the transition from the larger diameter of the first diameter 24 to the smaller diameter of the second diameter 28 and can serve as a stop to prevent the movement of the pin 18 or socket 20 within the pin hole 16 of the body 14.

Figure 3:
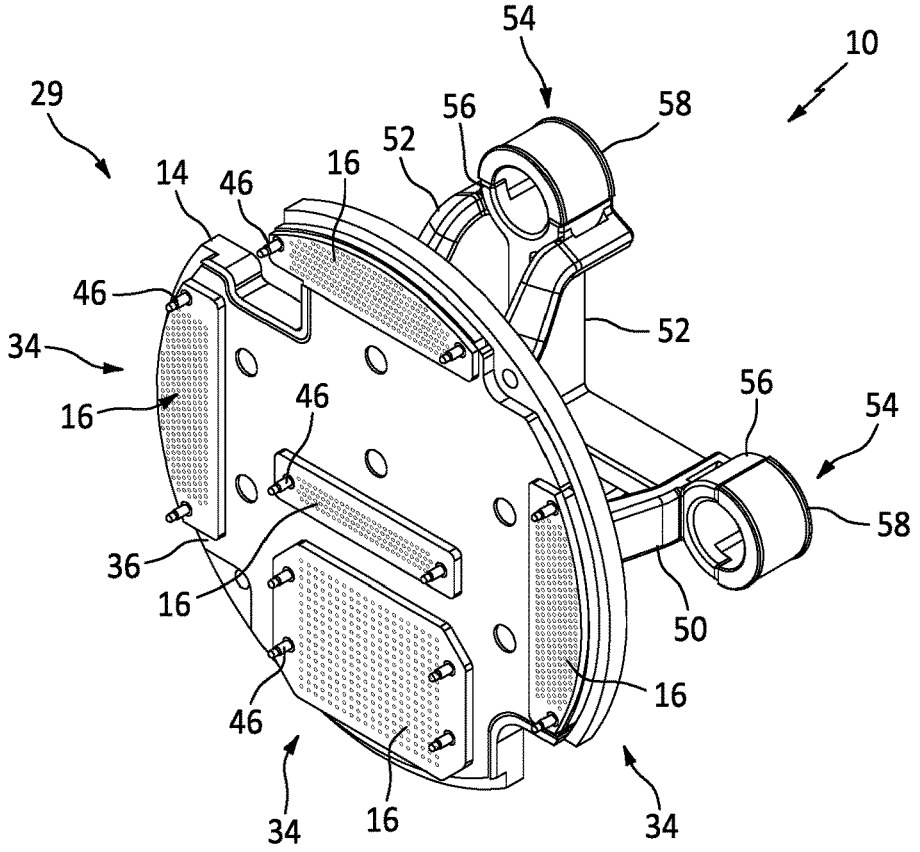
FIG. 3 is an isometric view of an exemplary cable connector.
Figure 4:
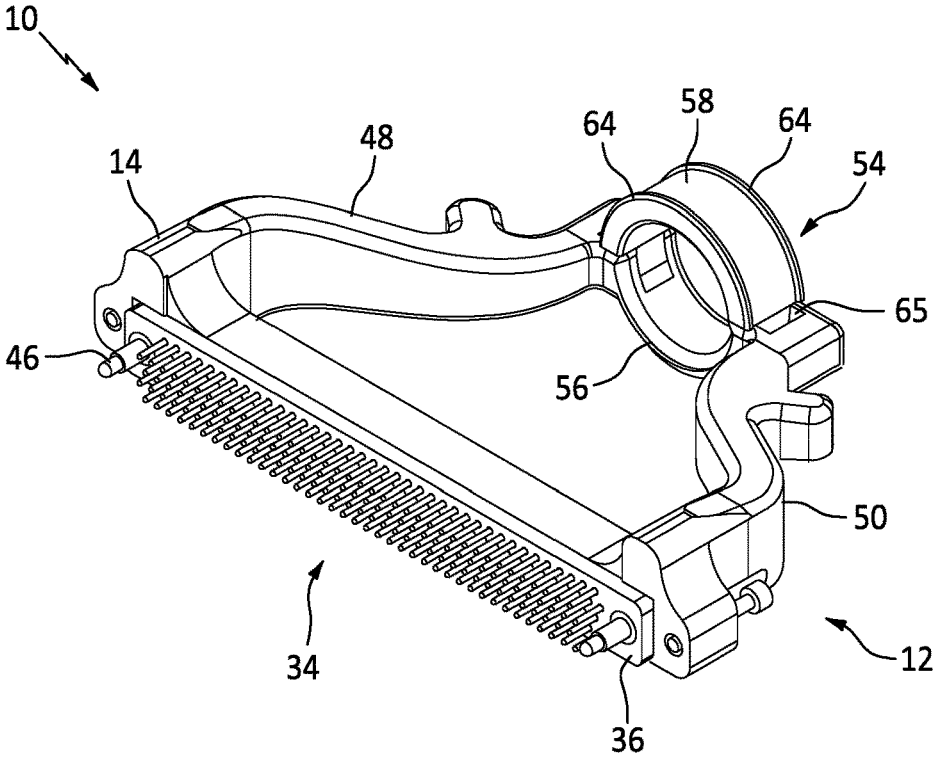
FIG. 4 is an isometric view of an exemplary cable connector.
Figure 5:
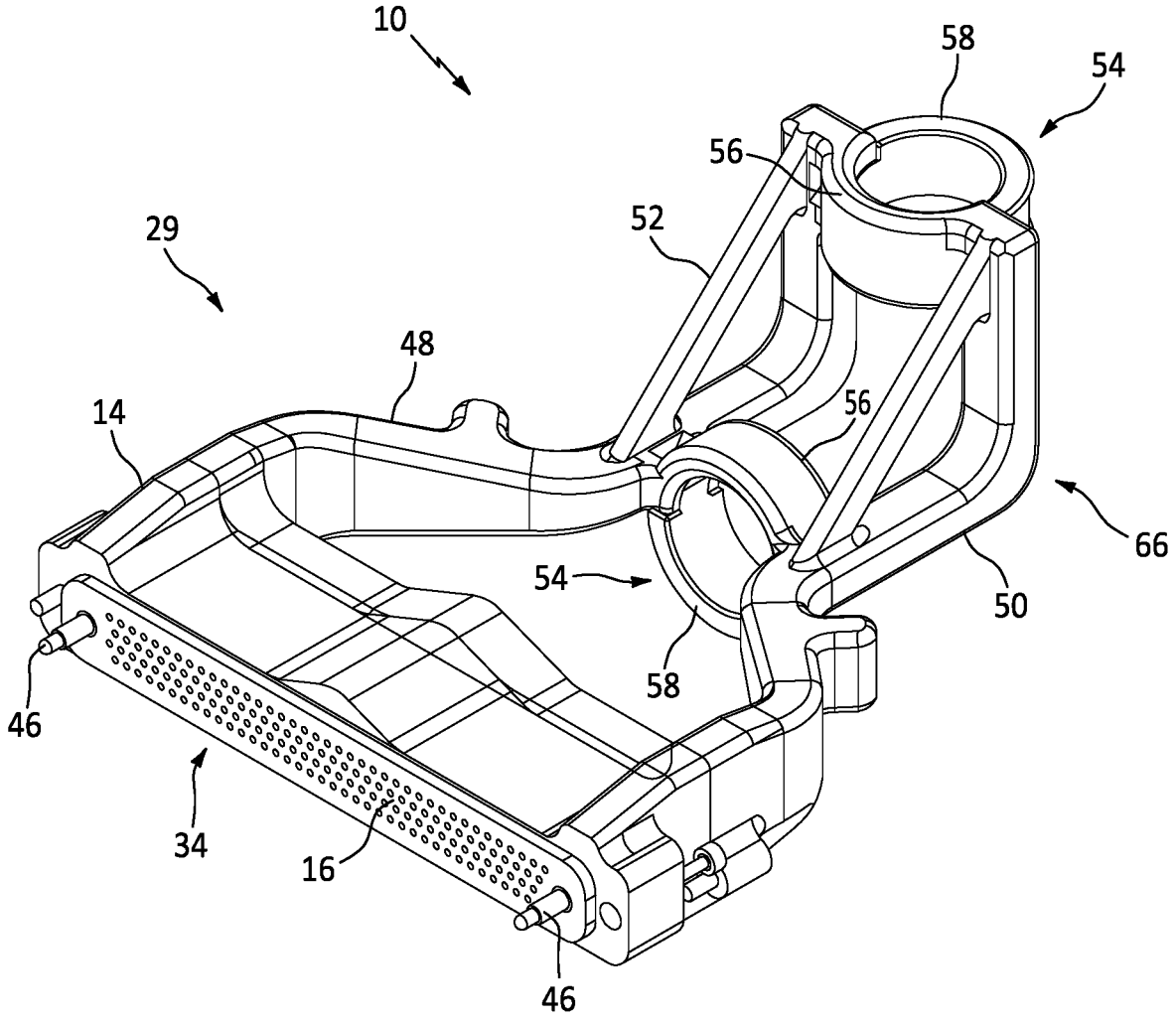
FIG. 5 is an isometric view of an exemplary cable connector.
Figure 6:
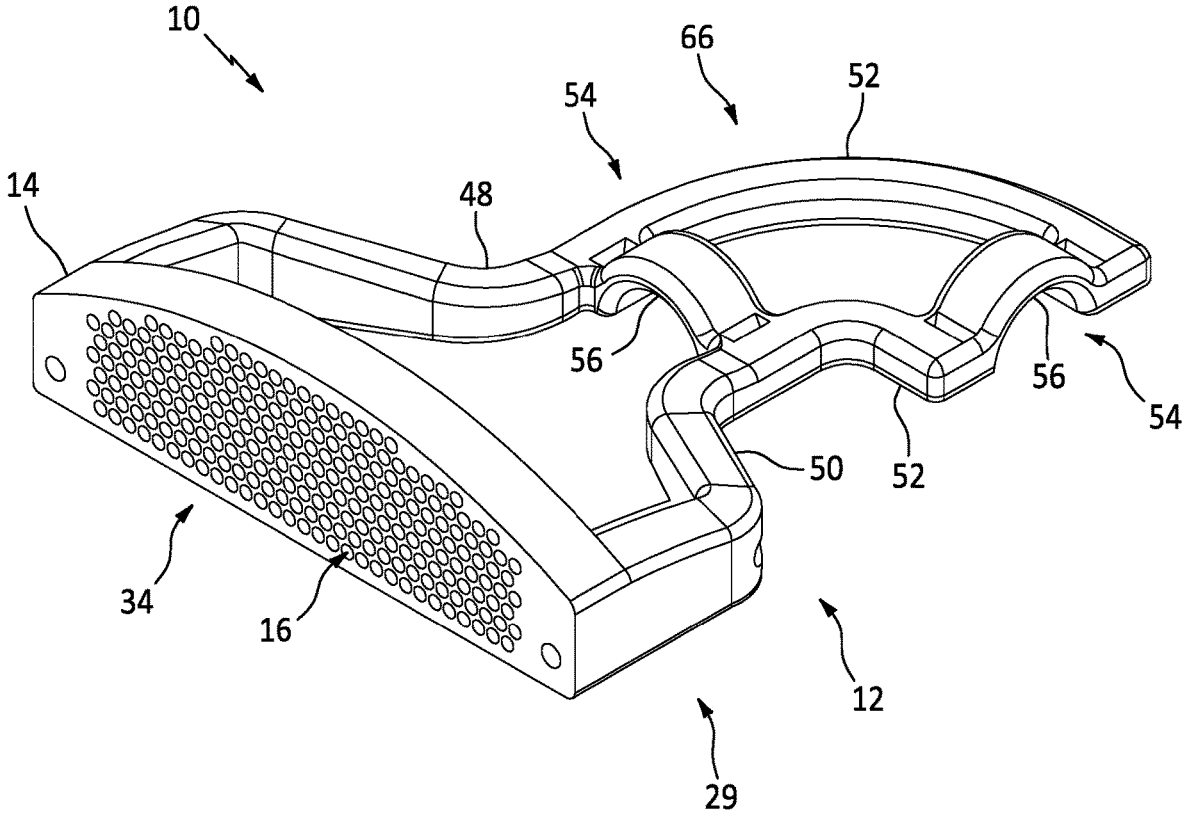
FIG. 6 is an isometric view of an exemplary cable connector.
Figure 7:
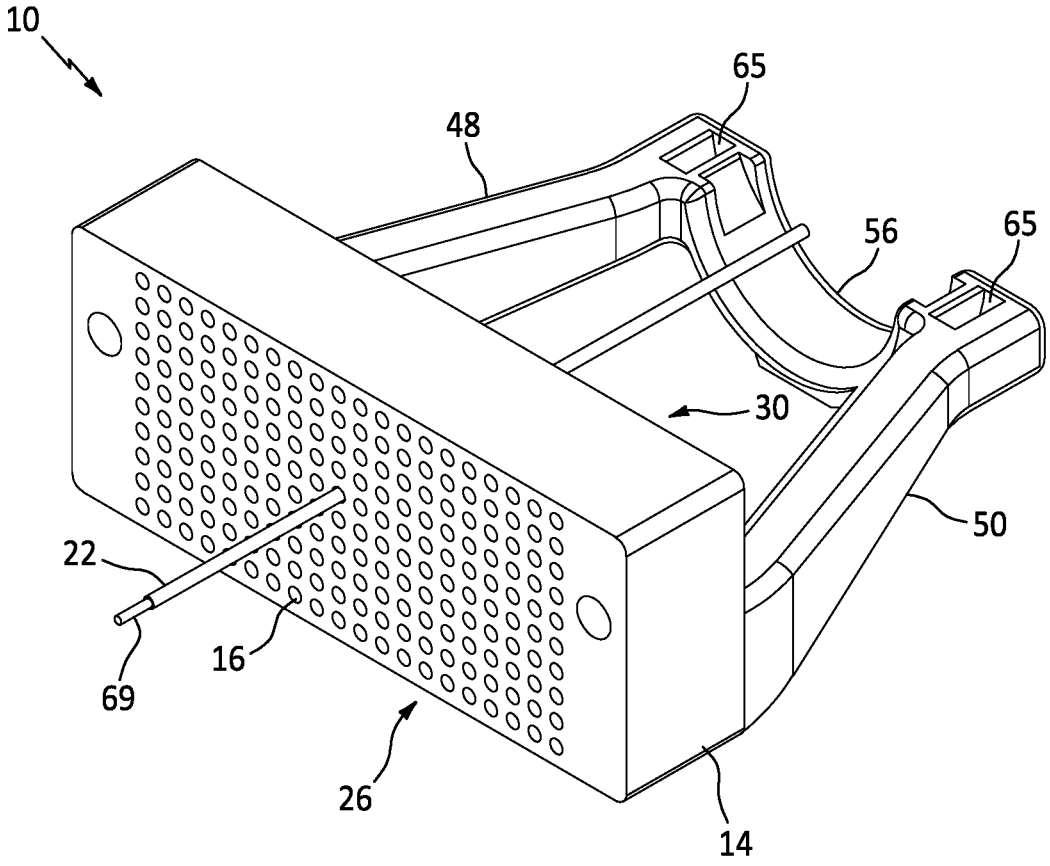
FIG. 7 is an isometric view of an exemplary cable connector wire assembly process.
Figure 8:
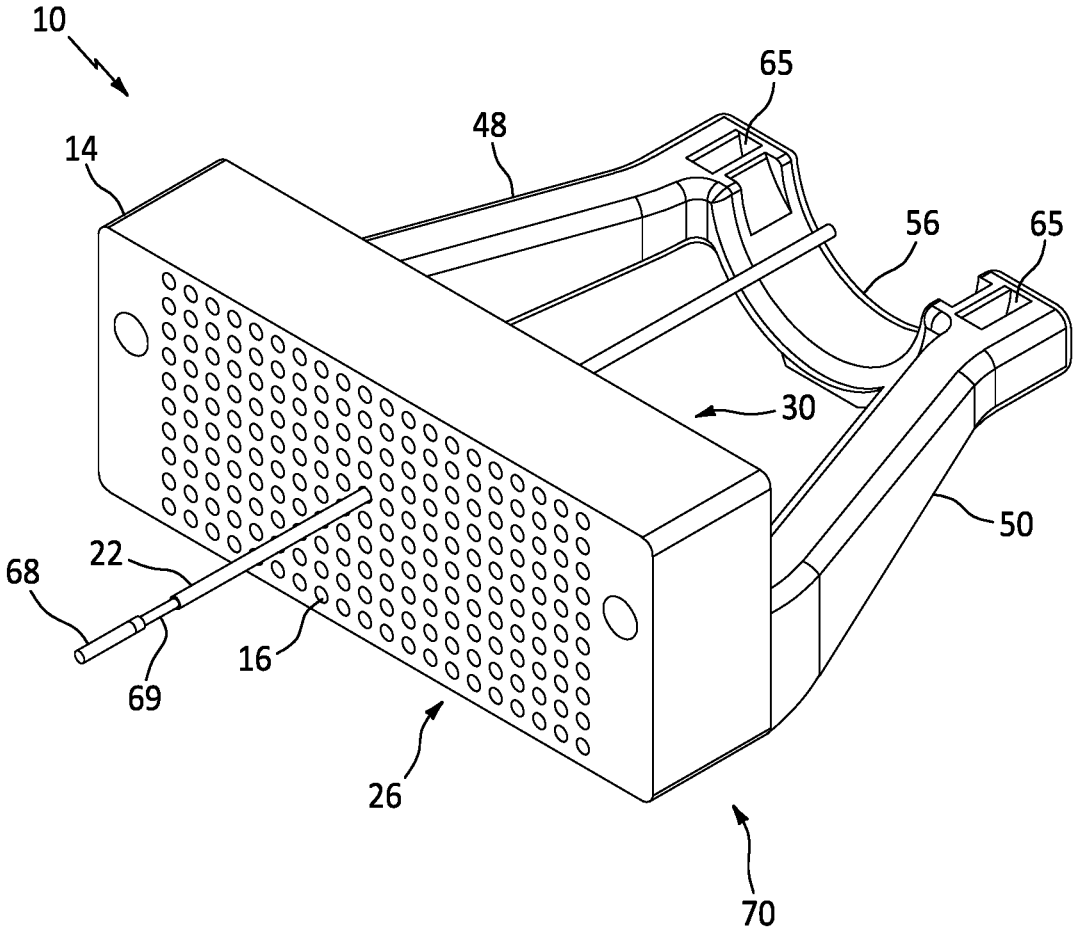
FIG. 8 is an isometric view of an exemplary cable connector wire assembly process.

It is contemplated that the array of pin holes 16 can be arranged in any variety of configurations depending on the configuration of a mating coupling 29 (shown in Fig FIGS. 3, 5 and 6). For example as seen in FIGS. 3-6, the array of pin holes 16 can be rectilinear in shape, crescent shaped, circular, semi-circular and the like. The array of pin holes 16 allows for any combination of pin 18 or socket 20 arrangements, such as a predetermined pattern 34 as shown. The predetermined pattern 34 of pins 18 or sockets 20 can be rearranged, reconfigured, and repaired after use. The adaptability of the connector 10 allows for use with many different mating connectors 29, since the pins 10 or sockets 20 are removably insertable in the pin holes 16.

The connector 10 also includes a cover 36 coupled to the front face 26 opposite the rear face 30. The cover includes a matching array of receivers 38 that mirror the array of pin holes 16 of the housing 12. The receivers 38 are right circular cylinder shaped and configured to accept the pins 18, such that pins 18 can extend beyond an outer surface 40 of the cover distal from the front face 26. The cover 36 can have a pattern 42 or outer contour that matches the housing 12 or has a unique shape, such as a rectilinear shape, crescent shape, circular, semi-circular and the like, for example as seen in FIGS. 3-6.

The cover 36 removably attaches with the housing 12 by use of fasteners 44. The fasteners 44 can be MIL-Spec fasteners in an exemplary embodiment. Guide posts 46 extend from the outer surface 40 of the cover 36. The guide posts 46 are configured to align the cable connector 10 with the mating connector 29 as well as provide for durable structural support in the coupling of the two connectors 10, 29.

The housing 12 includes a first arm 48 and second arm 50 that extend from the main body 14 rear face 30. The arms 48, 50 extend from the main body 14 so as to not impede the placement of wire 22 into the various pin holes 16. In the exemplary embodiment shown, the arms 48, 50 extend from the main body 14 at opposite sides 52 of the main body 14. In other embodiments, as seen in FIGS. 3 and 5, additional arms 52 can be deployed to provide support.

Figure 11:
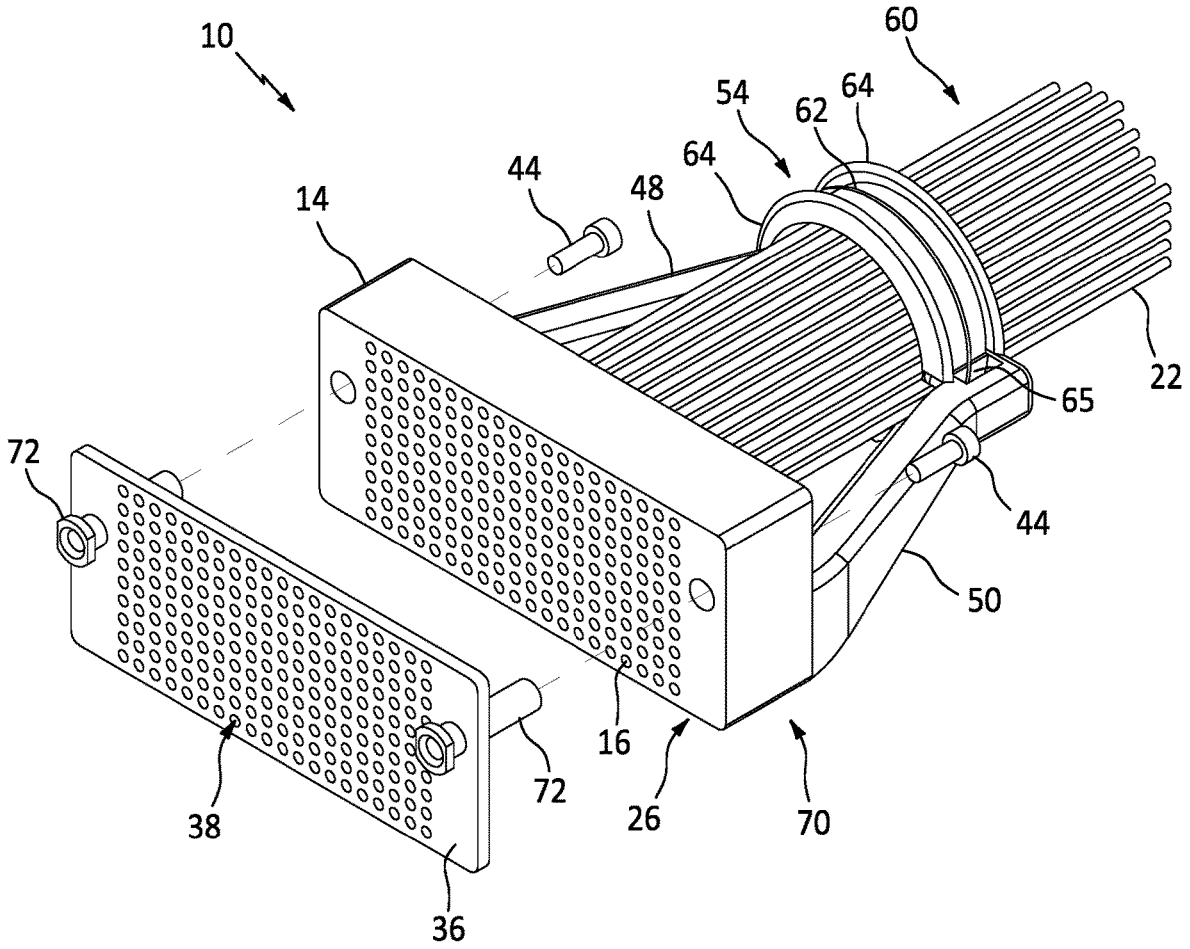
FIG. 11 is an isometric view of an exemplary cable connector wire assembly process.

A cable collar or simply collar 54 can be supported by the arms 48, 50, or 52. The collar 54 is configured to clamp and support the bundle of wires 22 attached to the cable connector 10 (as seen in FIG. 11). In an exemplary embodiment, the collar 54 can be a two piece assembly with a fixed portion 56 secured to the arms 48, 50 or 52, and a locking portion 58 that can be attached and detached from the fixed portion 56. The locking portion 58 can couple with the fixed portion 56 to form the collar 54. The collar 54 is shown as a cylindrical shaped structure to allow for the maximum volume and support of the wires 22 bundled together and supported by the collar 54. The collar 54 can be sized to match the size of the bundle of wire 60. The collar 54 is configured to provide strain relief to the bundle of wire 60. The collar 54 can be reinforced with a zip tie fastener 62 as needed. Raised sides 64 along the perimeter of the collar 54 can be utilized to contain the zip tie 62. Slots 65 can be formed in the collar 54 or arms 48, 50 to receive the zip tie 62.

As seen in FIGS. 1-4 and 7-11 the collar 54 is aligned with the pin holes and orthogonal to the rear face 30 such that a bundle of wire cable 60 can extend in a linear fashion with minimal bending. In the embodiments shown in FIGS. 5, 6, there are additional collars 54 and additional arms 52 that allows for a change in cable 60 direction, for example a 90 degree bend 66 relative to the alignment of the pin holes 16. The additional collars 54 provide the added support and strain relief to the wires 32 while providing a 90 degree change of direction for more convenient cable 60 management. It is contemplated that other angles can be utilized besides 90 degrees.

Figure 9:
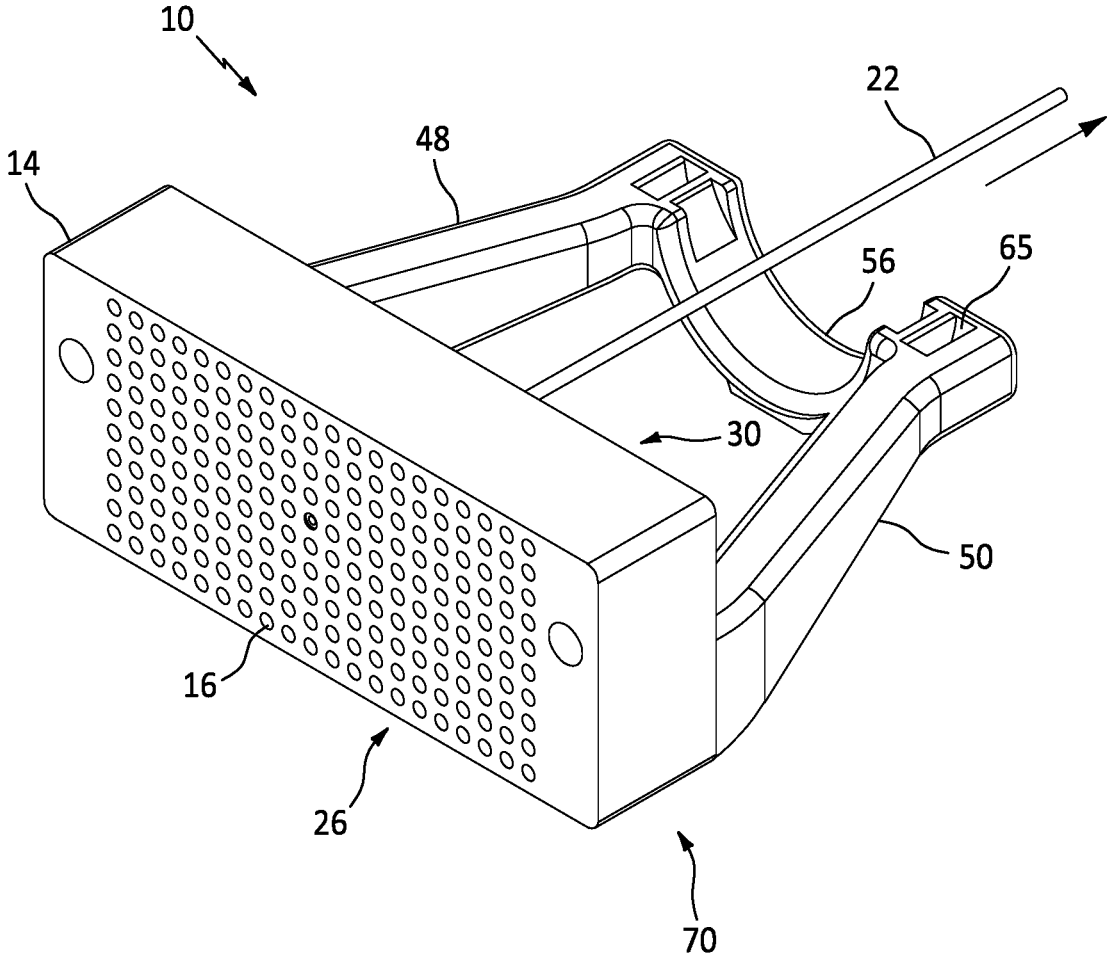
FIG. 9 is an isometric view of an exemplary cable connector wire assembly process.
Figure 10:
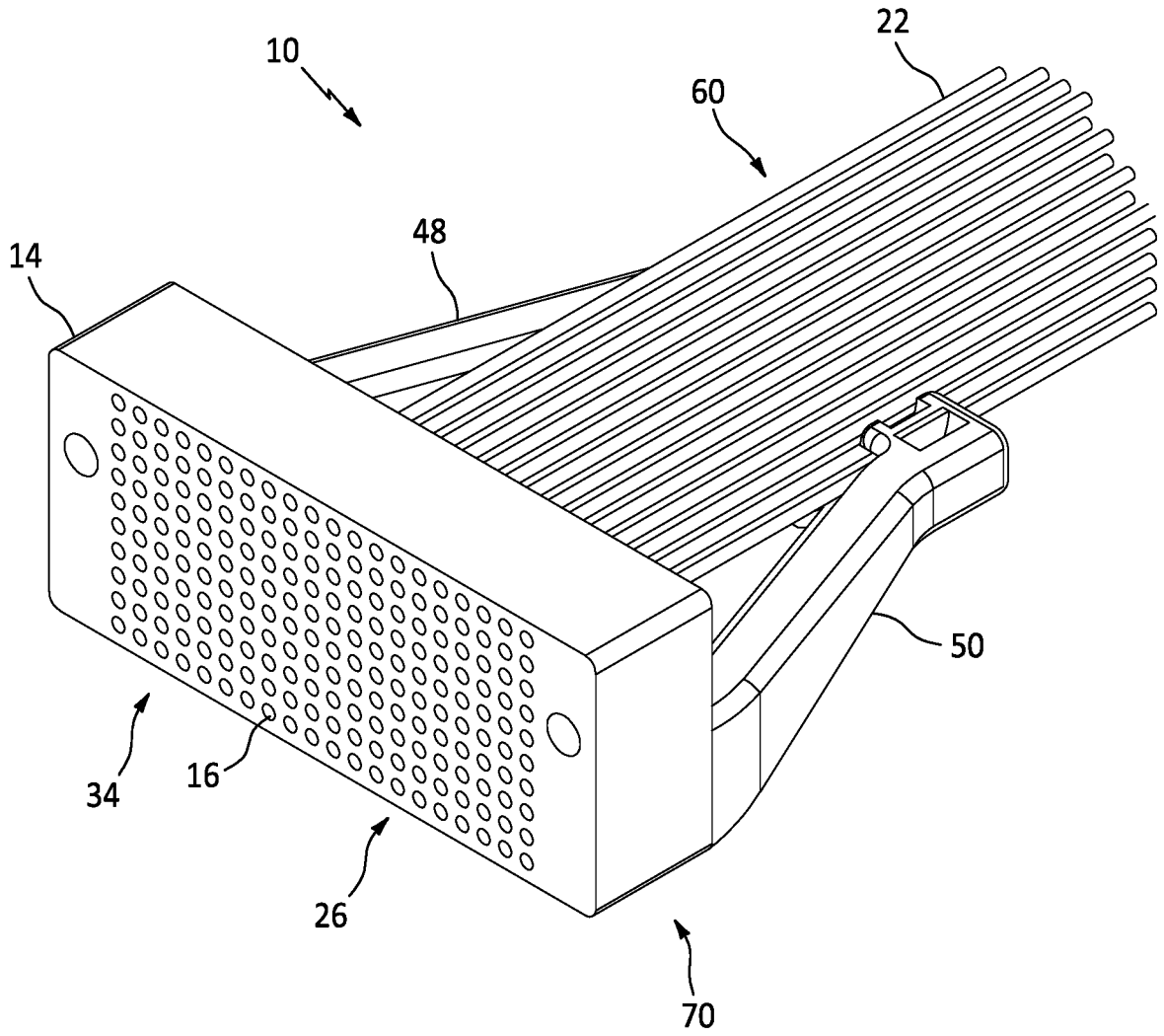
FIG. 10 is an isometric view of an exemplary cable connector wire assembly process.

Referring also to FIGS. 7-11 the assembly of the wires 22 into the wire bundle cable 60 is shown in a series of images. The wire 22 is inserted into a pin hole 16 on the rear face 30 of the body 14 through the pin hole 16 and out of the front face 26, shown in FIG. 7. A contact socket 68 can be attached to a terminal end 69 of the wire 22, shown in FIG. 8. In embodiments when the cable connector 10 is configured as a receptacle 70, the contact 68 is connected to the wire 22. In embodiments when the cable connector 10 is configured as a connector, the pin 16 is coupled to the wire 22. Crimp pins 16 or crimp sockets 20 can be utilized for easy attachment/detachment. The wire 22 can be pulled back to seat the contact socket 68 against the ledge 32 of the pin hole 16, as shown in FIG. 9. As seen in FIG. 10, the remainder of the wires 22 are inserted, capped and pulled back to seat the contact socket 68 to make-up the predetermined pattern 34 of the connector 10. At FIG. 11, the bundle of wire cable 60 is secured. The locking portion 58 is coupled with the fixed portion 56 of the collar 54. The zip tie 62 can be employed to secure the bundle 60. The cover 36 can be attached to the main body 14 at the front face 26 by use of the fasteners 44 secured to the guide post socket 72. The predetermined pattern 34 of the cable connector 10 can be changed by disassembly of the cable connector 10 in reverse order. The bundle 60 can be released, by cutting the zip tie 62 and detaching the locking portion 58. The cover 36 can be removed by unfastening the fasteners 44 and guide post 72. The wire 22 can be pushed forward such that the contact socket 68 is unseated from the ledge 32 and exposed proximate the front face 26 of the main body 14. The contact socket 68 can be removed from the wire 22. The wire 22 can be pulled out of the pin hole 16. Alternatively additional wire 22 can be inserted into empty pin holes 16 to add wire 22 and ultimately rearrange the predetermined pattern 34, as needed. The housing 12, the cover 36, wires 22 and pins 18 and sockets 20 are configured to be rearranged, repaired and reworkable; that is to be capable of being assembled and then disassembled and modified to have wires 22 in different locations, pins 18 and sockets 20 in different locations.

The housing 12, cover 36 and collar 54 can be easily manufactured by use of 3-D printing, for example by use of Polyjet. PolyJet is a 3D printing technology that produces smooth, accurate parts, prototypes and tooling. With microscopic layer resolution and accuracy down to 0.014 mm, it can produce thin walls and complex geometries using a wide range of materials. The guide post 46 and socket 72 can be machined, for example, from stainless steel material.

A technical advantage of the disclosed cable connector includes the robust, repeatable, repairable parts that can serve as a pin or socket assembly.

Another technical advantage of the disclosed cable connector includes an additive manufactured component that can be customized rapidly to match the connector of remote monitoring equipment.

Another technical advantage of the disclosed cable connector includes the capacity to create multi-connector assemblies.

Another technical advantage of the disclosed cable connector includes the capacity to create custom pin/socket layout.

Another technical advantage of the disclosed cable connector includes the ability to integrate keying features into the connector design.

Another technical advantage of the disclosed cable connector includes integrated strain relief in the housing of the connector.

Another technical advantage of the disclosed cable connector includes combining commercially available contacts with a purpose-build housing to contain the contacts in any array necessary to mate with the desired connector.

Another technical advantage of the disclosed cable connector includes temporary contact containment by which one device can act as several connectors with different configurations using only standard tools and fasteners for nondestructive disassembly and rearrangement.

Another technical advantage of the disclosed cable connector includes parts that can be unfastened to repair individual wires and add, remove, or rearrange contacts before reassembly of the connector.

Another technical advantage of the disclosed cable connector includes the capacity to mate to commercial connectors, as well as to be adapted to be a mating pair with any configuration of contacts, regardless of commercial availability.

There has been provided a cable connector. While the cable connector has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A cable connector comprising:

a housing including a main body having a front face opposite a rear face and pin holes formed through the main body extending between the front face and the rear face, a first arm and second arm extending from said main body distal from said rear face;

a cover removably coupled to said front face, said cover including receivers configured to align with said pin holes to receive at least one of a pin and a socket at a terminal end of at least one wire insertable through said pin holes;

fasteners removably coupled to said cover and said housing;

at least one guide post extending from an outer surface of said cover;

a collar supported between said first arm and said second arm; and a predetermined pattern of said wires coupled to at least one of the pin and the socket, wherein either said pin or said socket are insertable in said pin hole.

2. The cable connector according to claim 1, wherein said housing, said cover, said at least one wire, said pin and said socket are configured to be at least one of rearranged, repaired and reworkable.

3. The cable connector according to claim 1, wherein said predetermined pattern can be adjusted.

4. The cable connector according to claim 1, wherein said housing can contain multiple predetermined patterns.

5. The cable connector according to claim 1, wherein said collar comprises a fixed portion and a locking portion removably coupled to said fixed portion, said collar configured to provide strain relief to a bundle of said wire.

6. The cable connector according to claim 1, further comprising:

an additional arm coupled to said first arm and said second arm.

7. The cable connector according to claim 6, wherein said additional arm is coupled to an additional collar and configured with a 90 degree bend relative to the pin holes.

8. A cable connector comprising:

a housing including a main body having a front face opposite a rear face and pin holes formed through the main body extending between the front face and the rear face, a first arm and second arm opposite said first arm extending from said main body distal from said rear face;

a cover removably coupled to said front face, said cover including receivers configured to align with said pin holes to receive at least one of a pin and a socket at a terminal end of at least one wire;

fasteners removably coupled to said cover and said housing;

at least one guide post extending from an outer surface of said cover;

a collar supported between said first arm and said second arm; and a predetermined pattern of said wire inserted into said pin holes and coupled to at least one of the pin and the socket at a terminal end of said wire, wherein either of said pin and said socket are insertable in said pin hole.

9. The cable connector according to claim 8, wherein said housing, said cover, said at least one wire, said pin and said socket are configured to be at least one of rearranged, repaired and reworkable.

10. The cable connector according to claim 8, wherein said housing can contain multiple predetermined patterns.

11. The cable connector according to claim 8, wherein the first arm and the second arm are spaced apart to provide access to insert said at least one wire into said pin hole.

12. The cable connector according to claim 8, further comprising:

an additional arm coupled to said first arm and said second arm, wherein said additional arm is coupled to an additional collar and configured with a 90 degree bend relative to the pin holes.

13. The cable connector according to claim 8, wherein said predetermined pattern can be adjusted.

14. A process for configuring an adaptable cable connector comprising:

providing a housing including a main body having a front face opposite a rear face and pin holes formed through the main body extending between the front face and the rear face, a first arm and second arm extending from said main body distal from said rear face and a collar supported between said first arm and said second arm;

providing a detachable cover including receivers configured to align with said pin holes;

attaching said cover to said front face such that said receivers of said cover align with said pin holes of said main body;

inserting at least one wire through said pin holes; and forming a predetermined pattern of said wires inserted into said pin holes and coupled to at least one of a pin and a socket at a terminal end of said wires, wherein either of said pin and said socket are insertable in said pin hole.

15. The process of claim 14, further comprising:

rearranging at least one of said housing, said cover, said at least one wire, said pin and said socket.

16. The process of claim 14, further comprising:

adjusting said predetermined pattern.

17. The process of claim 14, further comprising:

creating multi-connector assemblies on said housing.

18. The process of claim 14, further comprising:

providing additional arms coupled to each of said first arm and said second arm, wherein said additional arms are coupled to an additional collar and said additional arms are configured with a 90 degree bend relative to the pin holes.

19. The process of claim 14, wherein said collar comprises a fixed portion and a locking portion removably coupled to said fixed portion, said collar configured to provide strain relief to a bundle of said wire.

20. The process of claim 14, further comprising:

providing additional arms on said housing and coupling additional collars to said additional arms configured to change a cable direction relative to the alignment of the pin holes.

* * * * *